US005794719A

United States Patent [19]

Holloway

[11] Patent Number: 5,794,719

[45] Date of Patent: Aug. 18, 1998

[54] GROUND BORING APPARATUS

[75] Inventor: David Edward Holloway, Swansea, United Kingdom

[73] Assignee: The Charles Machine Works, Inc., Perry, Okla.

[21] Appl. No.: 783,649

[22] Filed: Jan. 15, 1997

[30] Foreign Application Priority Data

Jan. 17, 1996 [GB] United Kingdom ..... 9600892

[51] Int. Cl.[6] ..... E21B 10/38; E21B 21/08

[52] U.S. Cl. ..... 175/21; 175/25

[58] Field of Search ..... 175/21, 26, 23, 175/25, 401, 424

[56] References Cited

U.S. PATENT DOCUMENTS

| | | | |
|---|---|---|---|
| 3,659,536 | 5/1972 | White | 175/21 X |
| 4,547,833 | 10/1985 | Sharp | 175/325 X |
| 5,148,880 | 9/1992 | Lee et al. | 175/393 |
| 5,176,219 | 1/1993 | Cole et al. | 175/21 X |
| 5,322,134 | 6/1994 | Dahn | 175/21 |
| 5,695,014 | 12/1997 | Jenne | 175/21 |

*Primary Examiner*—Frank Tsay
*Attorney, Agent, or Firm*—McKinney & Stringer, P.C.

[57] ABSTRACT

A housing for electrical/electronic apparatus associated with the boring apparatus has a coolant flowpath for directing coolant fluid to cool the electrical/electronic apparatus and/or the housing. A relief coolant outlet port is closed by closure comprising fusible material which fuses at a predetermined temperature thereby to open the relief outlet port. The temperature at which the material of the closure fuses is lower than the temperature at which substantial thermal damage would occur to the electrical/electronic apparatus within the housing (typically at a temperature substantially at or below 200° C).

20 Claims, 1 Drawing Sheet

GROUND BORING APPARATUS

BACKGROUND OF THE INVENTION

The present invention relates to ground boring apparatus.

Ground boring apparatus of the type used for boring sub-surface holes or bores (for example for laying of pipes) is well known. Often, such boring apparatus comprises a string of end to end connected rotating elements provided with a boring head having a radio transmitter fitted to facilitate tracking of the bored path below the ground surface. Because high temperatures arise at the boring head due to friction, coolant fluid (typically water) is pumped to cool the radio transmitter and/or the transmitter housing, the coolant subsequently being jetted forward of the boring head to aid the boring process and to cool the boring bit. On occasion, the coolant ejection jet may become blocked, in which eventually coolant flow ceases, thereby causing the temperature in the region of the radio transmitter/transmitter housing to become elevated to an extent at which damage (burn out) occurs to the transmitter. Transmitters are expensive and need to be replaced when damaged which also results in "down time" for the boring apparatus.

It is an object of the present invention, therefore, to provide means for cooling various components of a ground boring apparatus which are subjected to elevated temperatures during operation of the ground boring apparatus.

It is a further object of the present invention to provide such a ground boring apparatus wherein the components to be cooled include a housing for electrical/electronic apparatus and the electrical/electronic apparatus therein.

It is yet a further object of the present invention to provide such boring apparatus with a coolant flow path which assures continuous coolant flow around the housing and electrical/electronic apparatus even if coolant flow through the nozzle jet of the boring apparatus is blocked.

SUMMARY OF THE INVENTION

According to a first aspect, the invention provides ground boring apparatus comprising a housing for electrical/electronic apparatus and a coolant flowpath for directing coolant fluid to cool the electrical/electronic apparatus and/or the housing, the coolant flowpath comprising a relief coolant outlet port normally closed by closure means, the closure means comprising fusible material arranged to fuse at a predetermined temperature thereby to open the relief outlet port.

The fusible material of the closure means is arranged to fuse at a significantly lower temperature than the melting temperature for the material comprising the boring apparatus/housing. The temperature at which the fusible material fuses is furthermore preferably below the temperature at which substantial thermal damage would occur to the electrical/electronic apparatus in the housing.

It is preferred that the coolant flow path is provided with a primary coolant outlet, (preferably downstream of the relief coolant outlet) which primary coolant outlet is normally open to the passage of coolant fluid. Desirably, the primary coolant outlet comprises a jet or nozzle.

It is preferred that the boring apparatus comprises a boring head carrying a boring bit for ground boring. Desirably, the primary coolant outlet directs used coolant toward the boring bit preferably via the jet or nozzle. Advantageously, the housing for the electrical/electronic apparatus is provided immediately rearwardly of the portion of the boring head carrying the boring bit.

The closure means preferably comprises a threaded portion arranged to threadably engage with a complementarily threaded portion comprising the relief outlet port.

In a preferred embodiment, the closure means comprises a plug arranged to plug the relief outlet port.

In one preferred embodiment, the closure means may substantially entirely comprise the same fusible material such that the closure means is substantially homogeneous throughout. In this embodiment, substantially the entire closure will fuse when the predetermined "danger" temperature is reached.

In an alternative embodiment, the closure means may only partially comprise the fusible material such that when fused a relief flowpath is defined by the un-fused portion, or the un-fused portion is ejected from the relief outlet port.

The fusible material comprising the closure means is preferably arranged to fuse at a temperature substantially at or below 200° C., preferably substantially at or below 160° C.

A preferred fusible material comprising the closure means is an alloy of bismuth/tin.

In a preferred embodiment, the closure means is arranged to retain check valve means in the flowpath, which check valve means is advantageously arranged to regulate coolant flow toward the primary coolant outlet. It is preferred that the check valve is a one-way valve permitting coolant flow toward the primary outlet, but substantially inhibiting flow in the reverse direction. Desirably the check valve comprises a valve member normally biased into engagement with a valve seat by biasing means (such as a spring) arranged to act on the closure means of the relief coolant outlet.

It is preferred that the housing of the boring apparatus is arranged to house a radio transmitter.

According to a second aspect, the invention comprises a closure means for an aperture or port provided for ground boring apparatus, the closure means comprising means for securing in position so as to normally close the aperture or port, at least a portion of the closure means comprising a fusible material arranged to fuse at predetermined temperature to open the aperture or port.

Preferred features of the closure means and boring apparatus are as described above in relation to the first aspect of the invention.

The invention will now be further described in a specific embodiment by way of example only and with reference to the accompanying drawings.

BRIEF DESCRIPTION OF THE DRAWINGS

FIG. 1 is a schematic perspective view of boring apparatus according to the invention; and FIG. 2 is a sectional view longitudinally through a portion of the apparatus of FIG. 1.

DETAILED DESCRIPTION OF THE PREFERRED EMBODIMENT

Figure 7:
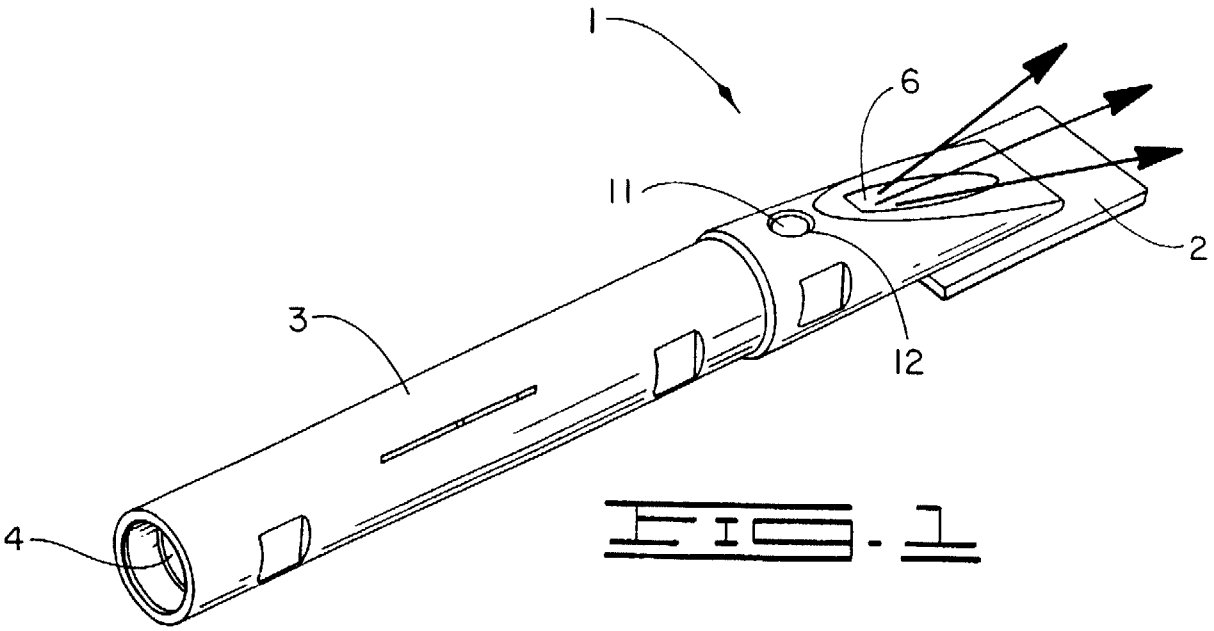
Figure 8:
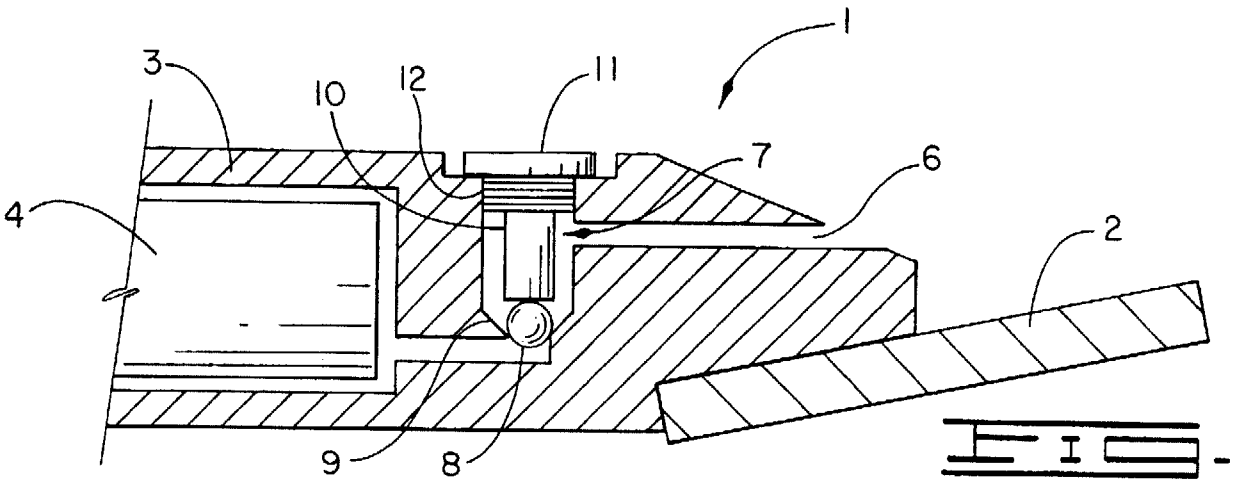

Referring to the drawings, boring apparatus comprises a boring head generally designated 1, having a boring bit 2 as its forward end and a radio transmitter housing 3 mounted rearwardly thereof. The boring head 1 is mounted at the end of a rotating drill string comprising a plurality of end to end connected elongate elements (not shown). The boring apparatus is driven in a conventional manner in which the drill string is rotated and urged forward to advance in a straight line, and urged forward without rotation to change direction underground (due to the angular inclination of boring bit 2 relative to the axis of the drill string).

During boring, radio transmitter 4 in housing 3 transmits signals to a portable surface receiver to give precise location, tilt and rotational orientation details for boring head 1. Boring head 1 is supplied during operation with a flow of cooling water pumped internally along the drill string.

The pumped water is forced through the cavity in housing 3 over radio transmitter 4 thereby cooling the radio transmitter, and also the walls of housing 3. This is extremely important because significant heat is generated by the underground boring action, and the temperature in the transmitter housing 3 would quickly reach a level at which thermal degradation/damage to the transmitter 4 would occur if the arrangement were not forcibly cooled. It is furthermore important that a continuous supply of coolant water is passed to the housing 3 which necessitates the removal of earlier supplied coolant water. To facilitate this requirement, cooling water is expelled from boring head 1 via a jet or nozzle 6 provided forward of the housing 3. Jet or nozzle 6 directs the spent coolant water toward the boring bit 2 which helps to "lubricate" the boring action, and also reduces frictionally induced elevated temperatures in the underground material in the vicinity of the boring head 1.

Typically a one way check valve 7 is provided in the coolant path between the transmitter housing 3 and the jet or nozzle 6. The valve serves to permit used coolant to flow downstream toward nozzle 6 but prevents flow in the reverse direction due to downstream increases in pressure. This is usually achieved by means of a ball valve 8 normally biased into engagement with a valve seat 9 by means of a spring 10. The spring 10/ball valve 8 arrangement is retained in place by a plug 11 which is removably threadably retained in a complementarily threaded aperture 12 provided in the boring head. Plug 11 may be unscrewed for periodic cleaning of the check valve 7 arrangement or replacement of the spring 10 or ball valve 8 when necessary.

Frequently during boring, nozzle jet 6 becomes blocked with drilling debris and consequently the flow of the coolant water over transmitter 4 ceases. When this occurs, the temperature of boring head 1 and housing 3 quickly increases to a level where damage to the radio transmitter occurs. When damage occurs to the transmitter the drill string needs to be retracted and replacement transmitter 4 installed in housing 3. This procedure is both time consuming and expensive (due to the inherent expense of scrapping and replacing radio transmitter 4).

In accordance with the present invention, plug 11 at least partially comprises a fusible material arranged to fuse at a temperature at which permanent damage to the transmitter 4 in housing 3 would not have been sustained. In practice, the threaded plug 11 may comprise a bismuth/tin alloy having a melting point in the region of 160° C. Upon fusing of the plug 11, a relief vent is effectively opened in boring head 1 permitting the pumped cooling water to exit housing head 1 via the now clear threaded aperture 12 in which fusible plug 11 was previously threaded. This enables the transmitter 4 to be cooled continually even when normal exit nozzle jet 6 has become blocked. Drilling may therefore be continued or halted without permanent damage to transmitter 4 being sustained.

While the above description constitutes preferred embodiments of the present invention, it will be appreciated that the invention is susceptible to modification, variation and change without departing from the proper scope and fair meaning of the accompanying claims.

I claim:

1. Ground boring apparatus which comprises a housing for electrical/electronic apparatus and a coolant flowpath for directing coolant fluid to cool the electrical/electronic apparatus and the housing, said coolant flowpath comprising a relief coolant outlet port and closure means for closing said port, wherein said closure means comprises fusible material arranged to fuse at a predetermined temperature thereby to open said relief outlet port.

2. Ground boring apparatus according to claim 1, which includes a boring head carrying a boring bit for ground boring.

3. Ground boring apparatus according to claim 1, wherein said coolant flow path has a primary coolant outlet, which primary coolant outlet is normally open to the passage of coolant fluid.

4. Ground boring apparatus according to claim 3, wherein the primary coolant outlet comprises a jet or nozzle.

5. Ground boring apparatus according to claim 4, which includes a boring head carrying a boring bit for ground boring.

6. Ground boring apparatus according to claim 5, wherein the primary coolant outlet is arranged to direct coolant toward said boring bit.

7. Ground boring apparatus according to claim 1, wherein said closure means comprises a first threaded portion and said relief outlet port comprises a further threaded portion arranged to complementarily engage with said first threaded portion.

8. Ground boring apparatus according to claim 1, wherein said closure means comprises a plug arranged to plug the relief outlet port.

9. Ground boring apparatus according to claim 1, wherein said closure means is substantially entirely comprised of said fusible material such that the closure means is substantially uniform or homogeneous throughout.

10. Ground boring apparatus according to claim 1, wherein part of said closure means comprises said fusible material such that when fused a relief flowpath is defined by an un-fused portion thereof, or the un-fused portion is ejected from said relief outlet port.

11. Ground boring apparatus according to claim 1, wherein said fusible material has a fusing temperature substantially lower than the temperature at which substantial thermal damage would occur to said electrical/electronic apparatus.

12. Ground boring apparatus according to claim 11, wherein said fusible material is arranged to fuse at a temperature substantially at or below 200° C.

13. Ground boring apparatus according to claim 1, wherein said fusible material is an alloy of bismuth/tin.

14. Ground boring apparatus according to claim 1, wherein said coolant flow path has a primary coolant outlet and wherein the closure means is arranged to retain check valve means in the flowpath, which check valve means is arranged to regulate coolant flow toward the primary coolant outlet.

15. Ground boring apparatus according to claim 14, wherein said check valve means comprises a one-way valve permitting coolant flow toward said primary outlet means, but substantially inhibiting flow in the reverse direction.

16. Ground boring apparatus according to claim 14, wherein said check valve means comprises a valve member biased into engagement with a valve seat by biasing means arranged to act on said closure means.

17. Ground boring apparatus according to claim 1, wherein said electrical/electronic apparatus is a radio transmitter.

18. Ground boring apparatus according to claim 2, wherein said electrical/electronic apparatus is a radio transmitter.

19. Ground boring apparatus according to claim 18, wherein said radio transmitter is arranged to transmit signals to a portable surface receiver to give location, tilt and rotational orientation details for said boring head.

20. A closure for an aperture or port of a coolant flowpath provided for ground boring apparatus, said closure comprising means for securing said closure in position so as to normally close the aperture or port, at least a portion of said closure comprising a fusible material arranged to fuse at predetermined temperature to open the aperture or port.

* * * * *